United States Patent [19]

Rijnders

[11] 4,308,706

[45] Jan. 5, 1982

[54] SUPPORT BEAM FOR WALL OR CEILING PANELS

[75] Inventor: Willem Rijnders, Alblasserdam, Netherlands

[73] Assignee: Hunter Douglas International N.V., Curacao, Netherlands Antilles

[21] Appl. No.: 201,607

[22] Filed: Oct. 28, 1980

Related U.S. Application Data

[63] Continuation of Ser. No. 14,714, Sep. 23, 1979.

[30] Foreign Application Priority Data

Sep. 24, 1978 [DE] Fed. Rep. of Germany ... 7805600[U]

[51] Int. Cl.[3] ..... E04B 5/52

[52] U.S. Cl. ..... 52/738; 52/489

[58] Field of Search ..... 52/738, 735, 473, 474, 52/481, 482, 78

[56] References Cited

U.S. PATENT DOCUMENTS

| | | | |
|---|---|---|---|
| 3,016,584 | 1/1962 | Fatula | 52/473 X |
| 3,028,192 | 4/1962 | Jewell | 52/482 |
| 3,044,586 | 7/1962 | Cassels | 52/669 |
| 3,271,920 | 9/1966 | Downing | 52/735 |
| 3,557,513 | 1/1971 | Girard | 52/738 |
| 3,561,180 | 2/1971 | Wise | 52/735 X |
| 3,640,033 | 2/1972 | Rijnders | 52/36 |
| 4,095,385 | 6/1978 | Brugman | 52/489 |

FOREIGN PATENT DOCUMENTS

| | | | |
|---|---|---|---|
| 431010 | 8/1967 | Switzerland | 52/473 |
| 1057593 | 2/1967 | United Kingdom . | |
| 1064521 | 4/1967 | United Kingdom . | |
| 1132773 | 11/1968 | United Kingdom . | |
| 1258366 | 12/1971 | United Kingdom . | |
| 1489422 | 10/1977 | United Kingdom . | |

*Primary Examiner*—J. Karl Bell

*Attorney, Agent, or Firm*—Pennie & Edmonds

[57] ABSTRACT

A beam for supporting elongated panels from a fixed structure to provide a wall or a ceiling finish is disclosed having a generally U-shape, as shown in FIG. 2, with outwardly extending flanges (2) and downwardly extending mushroom-shaped connector lugs (3). Lugs (3) are cut from the material of the flange mid-way of the width of the flange (2) and said lugs are no greater in width than one-half the width of the flange (2).

3 Claims, 3 Drawing Figures

SUPPORT BEAM FOR WALL OR CEILING PANELS

CROSS REFERENCE TO OTHER APPLICATIONS

This application is a continuation of my copending application Ser. No. 014,714 filed Sept. 23, 1979.

BACKGROUND OF THE INVENTION

1. Field of the Invention

This invention relates to the field of support beams for supporting elongated panels from a fixed building structure, such as a wall or ceiling.

2. Prior Art

Two general approaches have been taken to the support of elongated panels from support beams secured to walls or ceilings. In the first approach, various connecters have been used to connect the panels to the support beams. In a second approach, attempts have been made to eliminate the need for the connecter by so shaping portions of the beam that the panels may be supported directly from parts of the beam without intervening additional parts.

One example of the first approach to panel support in which a specially designed connecter is used to connect the panels to the beams is disclosed in U.S. Pat. No. 3,640,033. Such additional attachment parts add to the cost of the installation, both in the cost of the part itself and in the labor of installation.

Efforts have been made to provide attachment directly between the panels and the beam, but these generally have not proved satisfactory since the anticipated cost savings over the first type of approach mentioned above are not entirely appreciated, due to the complexity of the manufacture of the shapes for the beams which, if too greatly simplified, often results in a beam and panel arrangement in which the connection between the two is insufficient or weakens the beam itself. That is to say, that the problem is to design a beam which is both simple and economical to manufacture but in which sufficient strength is provided, both in the beam structure itself and the portions thereof that connect with the panels to support the panels securely against displacement in use.

BRIEF DESCRIPTION OF THE INVENTION

The problem of producing a support beam having sufficient strength to support a plurality of panels without the need for an intervening connecter has been solved by the present invention. The beam of this invention has outwardly extending flanges along its length, which flanges have integral connecter members for connection to the panels. The integral connecter members are mushroom-shaped connecter lugs punched or die cut and bent outwardly of the flanges for engagement with the panels. The beam insures that the flanges retain a large portion of their strength which is important for a number of reasons. First of all, the flanges must be strong enough to support the panels to be applied. Secondly, it is frequently desired to rest heat or sound insulating materials on these flanges, in which case the flanges must support this weight in addition to the panels.

To this end, the invention provides for the integral mushroom-shaped connecter lugs to have the bend where they join integrally with the flange positioned toward the inside of the beam with respect to the opening from which such lugs are punched and bent. Further, the areas from which the connecters are punched are positioned in the center of the flange width and have a lateral dimension in the direction of the flange width equal to no more than half the flange width. This arrangement insures that there is sufficient flange material, both laterally outwardly and laterally inwardly of the openings produced to lend the requisite strength to the flanges for the purposes above referred to.

Still another feature of the invention is that the beam is designed to receive panels of different width by suitably selecting intervals for the mushroom-shaped connecter lugs, which intervals are less than the width of a standard panel and, further, so dimensioning the intervals between the lugs as to insure that at least two lugs are arranged on a standard panel width. Commercially available standard panels vary in width from about 8 cm. to 10.5 cm.

Still further, the invention contemplates the use of additional connecting holes punched or die cut out of the flanges, in order to receive connecting elements for connecting adjacent beams to each other.

BRIEF DESCRIPTION OF THE DRAWINGS

The construction and use of the beam of the invention will be apparent to those skilled in the art from the following description and drawings, in which.

DETAILED DESCRIPTION OF THE PREFERRED EMBODIMENT

Figure 1:
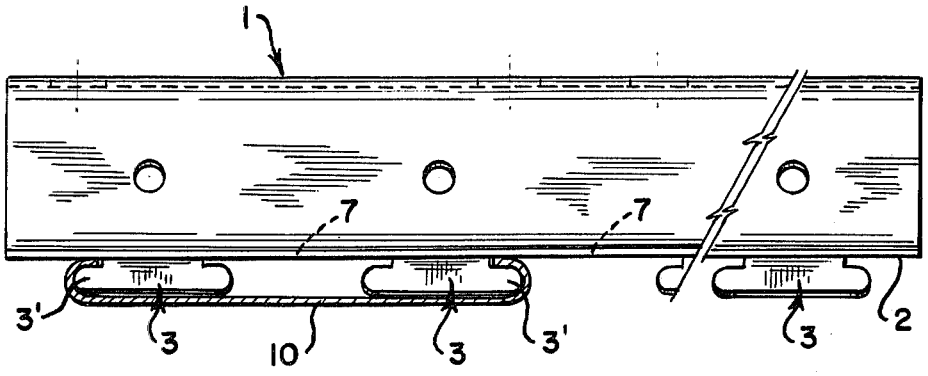
FIG. 1 shows a side elevation of the beam of the invention.
Figure 2:
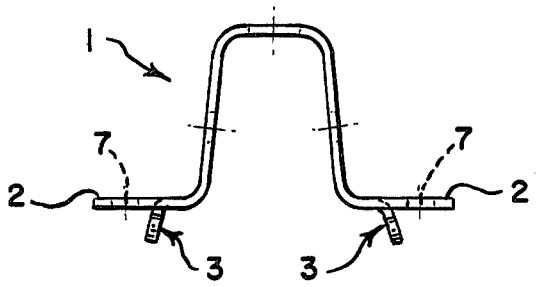
FIG. 2 shows an end view of the beam of FIG. 1.

As shown in FIG. 1, the beam 1 of the invention is elongated and, as shown in FIG. 2, has a cross-section generally in the form of a U-shape. Flanges 2 are bent to extend outwardly from the central body portion of the beam with both of the flanges 2 being in the same plane. Mushroom-shaped connecter lugs 3 are punched or die cut from the material of the flanges 2 and bent outwardly of the flanges in the direction away from the main body of the U-shaped beam 1. The mushroom-shaped panel connecting lugs 3 have the shape shown in FIG. 1, which is suitable for support of panels of various shapes, particularly a panel such as panel 10 which has a generally "C"-shape in cross-section, as shown in FIG. 1. Such a panel is of flexible sheet metal or other like material and the longitudinal lateral edges may simply be snapped over the ears 3' on two of the lugs 3. As shown in FIG. 1, the panel 10 is positioned on two adjacent lugs 3. However, depending upon the width of the panel 10, there may be one or more unused lugs 3 between the two that are used for support of the panel. It will also be apparent that the panels extend transverse to the longitudinal direction of beam 1.

Figure 3:
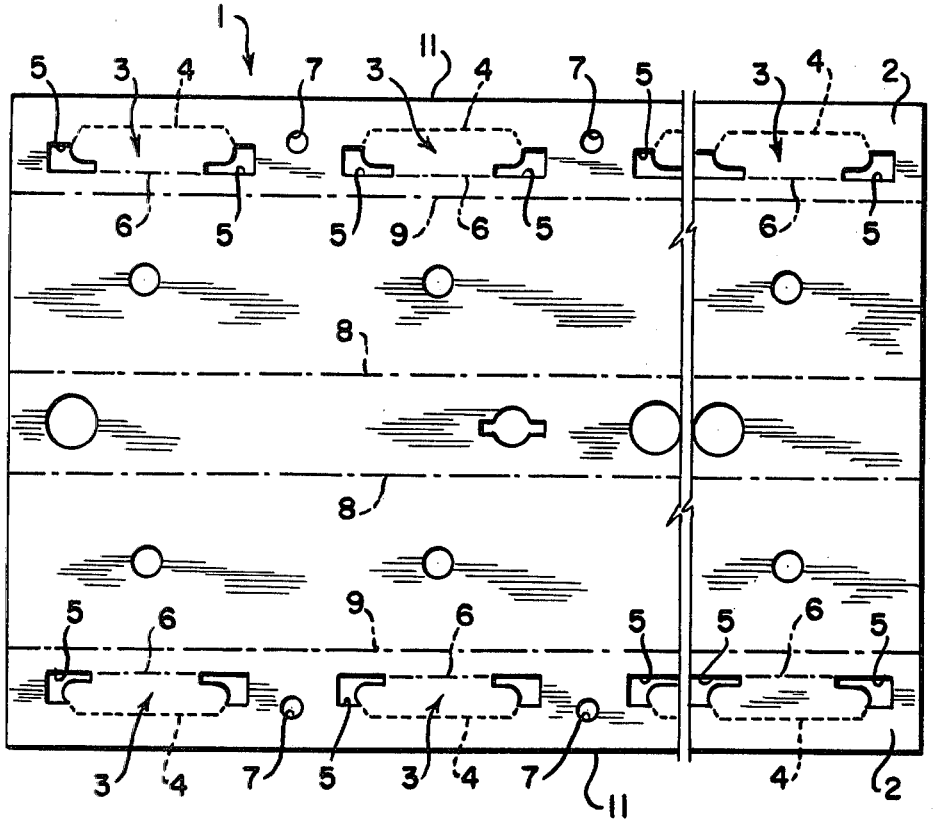
FIG. 3 shows a top view of the sheet for a beam after it has been punched or die cut but before it has been bent into shape.

FIG. 3 shows a punched or die cut metal sheet before being folded or bent into the final shape for the beam. The dot-dash lines 6, 8 and 9 are lines along which the metal will be bent. The fold lines 8 will be bent to form the bight and the legs of the U-shaped body portion of the beam 1, while the fold lines 9 indicate where the bend will be made to provide the flanges 2.

The reference numeral 4 indicates the dotted line along which the material of the sheet is punched or die cut to provide the mushroom-shaped connecter lugs 3. The numeral 5 indicates openings cut from the material of the sheet before the holding lugs 3 are punched out and bent down. This insures that when the lugs 3 are punched out, no ridges will be formed in the sheet at the edges of the lugs 3 which might otherwise occur and cause deformation of the lugs 3 when they are bent into position. Still further, in the absence of the openings 5 being provided before bending the lugs 3 into position, such ridges in the sheet may interfere with proper securement of the panels on the lugs 3.

As shown in FIG. 3, the lugs 3 are punched or die cut from the sheet in the area of the flanges 2. More specifically, the area of material to become lugs 3 is located generally centrally of the width of the flanges 2. That is to say, that the lugs 3 are punched out generally midway between the fold line 9 and the lateral outer edges 11 of the flanges. Further, the width of the lugs 3, i.e. the distance from the fold line 6 to the parallel portion of the punching line 4, does not exceed one-half the width of the flange between the fold line 9 and the edge 11. It will be noted that the bend line 6 for each of the lugs is positioned on that side of the lugs 3 which is toward the longitudinal center line of beam 1. It will also be seen that the holding lugs 3 are bent at an angle close to but not quite 90° with respect to the flange 2 (having reference to the angle that is to the outside of the holding lugs 3).

The holes 7 are similarly positioned intermediate the width of the flanges 2 and are provided so that adjacent beams 1 may be connected together with suitable connecters (not shown).

I claim:

1. A beam for supporting elongated wall or ceiling panels from an underlying structure comprising said beam having a generally U-shaped cross-section, each leg of said beam being bent to provide an outwardly extending flange on each side of said beam, each of said flanges extending along the length of the beam, a plurality of connecter lugs on each flange, said lugs having been cut and bent from the material of said flanges to form lugs having an ear portion on each end thereof, said lugs extending outwardly of said flanges in a direction generally opposite to the direction in which said legs extend from said flanges, each of said lugs lying in a plane extending generally parallel to the length of the beam, the openings produced upon cutting and bending said lugs being arranged substantially mid-way of the width of the flanges, and said openings and said lugs having a width no more than half the width of the flange from which said lugs are bent.

2. The beam according to claim 1, in which the bend line along which the lugs join the flange is on that side of the openings from which the lugs were punched that is toward the longitudinal center line of the beam.

3. The beam according to either claim 1 or claim 2, in which the intervals between adjacent lugs on each flange are no greater than the width of a standard panel, and each flange having at least two lugs arranged on a standard panel width.

* * * * *

UNITED STATES PATENT AND TRADEMARK OFFICE

CERTIFICATE OF CORRECTION

PATENT NO. : 4,308,706

DATED : January 5, 1982

INVENTOR(S) : Willem Rijnders

It is certified that error appears in the above—identified patent and that said Letters Patent is hereby corrected as shown below:

On the title page, Item 63, change "Sep. 23, 1979" to -- February 23, 1979 --.

Page 1, Column 1, line 8, change "Sept. 23, 1979" to -- February 23, 1979 --.

Signed and Sealed this

*Twenty-third* Day of *March 1982*

[SEAL]

*Attest:*

GERALD J. MOSSINGHOFF

*Attesting Officer*

*Commissioner of Patents and Trademarks*